US006036355A

United States Patent [19]

Yant et al.

[11] Patent Number: 6,036,355

[45] Date of Patent: Mar. 14, 2000

[54] REACTOR MIXING ASSEMBLY

[75] Inventors: Robert Yant, Medina; Piotr Piechuta, Akron; Kevin Butler, Bedford; Mark Piechuta, Alliance, all of Ohio

[73] Assignee: Quantum Technologies, Inc., Twinsburg, Ohio

[21] Appl. No.: 08/942,575

[22] Filed: Oct. 1, 1997

Related U.S. Application Data

[63] Continuation-in-part of application No. 08/893,601, Jul. 14, 1997.

[51] Int. Cl.[7] ..... B01F 5/04; B01F 15/02

[52] U.S. Cl. ..... 366/171.1; 366/172.1; 366/181.4; 366/181.6; 366/307

[58] Field of Search ..... 366/64, 66, 96–99, 366/102–104, 107, 168.1, 171.1, 172.1, 172.2, 174.1, 181.4, 181.6, 302, 307; 162/57, 243; 422/134, 135

[56] References Cited

U.S. PATENT DOCUMENTS

| | | | |
|---|---|---|---|
| 2,914,385 | 11/1959 | Massey et al. | 366/307 |
| 3,321,283 | 5/1967 | Ewald . | |
| 3,782,700 | 1/1974 | Wittrock . | |
| 3,798,119 | 3/1974 | Singh . | |
| 3,873,414 | 3/1975 | Rocher et al. . | |
| 3,888,967 | 6/1975 | Andersson et al. . | |
| 3,936,240 | 2/1976 | Dochterman . | |
| 3,993,219 | 11/1976 | Franzosi . | |
| 3,997,300 | 12/1976 | Boatwright et al. . | |
| 4,032,117 | 6/1977 | Burgess . | |
| 4,037,826 | 7/1977 | Hulslander et al. . | |
| 4,053,352 | 10/1977 | Hultman et al. . | |
| 4,075,712 | 2/1978 | Geyer . | |
| 4,098,640 | 7/1978 | Sander et al. . | |
| 4,162,187 | 7/1979 | Smith et al. . | |
| 4,334,956 | 6/1982 | Farrington et al. . | |
| 4,339,206 | 7/1982 | Ahs | 162/243 |
| 4,384,920 | 5/1983 | Markham et al. . | |
| 4,416,548 | 11/1983 | Carre et al. | 366/171.1 |
| 4,483,624 | 11/1984 | Bacon, Jr. et al. | 366/307 |
| 4,718,978 | 1/1988 | Spannuth et al. . | |
| 4,756,837 | 7/1988 | Nadezhdin . | |
| 4,911,787 | 3/1990 | Shimokura et al. . | |
| 4,941,752 | 7/1990 | Yant et al. . | |
| 5,143,702 | 9/1992 | Der et al. . | |
| 5,188,808 | 2/1993 | Lilja et al. | 422/135 |
| 5,228,775 | 7/1993 | Horn et al. | 366/320 |
| 5,234,546 | 8/1993 | Chamblee . | |
| 5,263,774 | 11/1993 | Delcourt | 366/307 |
| 5,304,355 | 4/1994 | Yant et al. . | |
| 5,372,679 | 12/1994 | Costa et al. . | |
| 5,382,322 | 1/1995 | Magnotta et al. . | |
| 5,397,434 | 3/1995 | Costa et al. . | |
| 5,439,556 | 8/1995 | Sethna et al. . | |
| 5,472,568 | 12/1995 | Mullen et al. . | |
| 5,500,085 | 3/1996 | Magnotta et al. . | |
| 5,607,233 | 3/1997 | Yant et al. . | |
| 5,725,306 | 3/1998 | Kappel et al. | 366/172.2 |

*Primary Examiner*—Charles E. Cooley
*Attorney, Agent, or Firm*—Watts, Hoffmann, Fisher, & Heinke, Co., L.P.A.

[57] ABSTRACT

A continuous dynamic mixing assembly includes a mixing chamber having an inner wall which is generally symmetrical about a central axis. At least one first fluid inlet introduces first fluid material into the mixing chamber. At least one second fluid inlet introduces second fluid material into the mixing chamber. At least one outlet permits fluid to leave the mixing chamber. First baffles extend along the inner wall generally parallel to the axis for disrupting fluid flow generally circumferentially in the mixing chamber. Second baffles extend generally transverse to the axis for disrupting fluid flow generally axially in the mixing chamber. A rotatable agitator includes a cylindrical central portion extending in the mixing chamber along the axis and has at least one blade having a twisted orientation on the central portion. A relative construction and arrangement among the first baffles, the second baffles and the agitator enable residence time of fluid in the reactor to be selectively adjusted.

42 Claims, 4 Drawing Sheets

REACTOR MIXING ASSEMBLY

CROSS-REFERENCE TO RELATED APPLICATION

This patent application is a continuation-in-part of patent application Ser. No. 08/893,601, entitled, "Method of Oxidizing White and Black Liquor," filed Jul. 14, 1997.

FIELD OF THE INVENTION

The present invention relates to a continuous dynamic mixing assembly for mixing first and second fluid materials together and, in particular, to a reactor mixer for oxidizing liquors for use in the paper pulping industry.

BACKGROUND OF THE INVENTION

In some paper pulping processes, a solution referred to as "oxidized white liquor" is used. Oxidized white liquor is typically made by oxidizing reducing compounds found in white liquor such as sodium sulfide, sodium polysulfide and sodium thiosulfate to form an oxidized white liquor having non-reducing compounds such as sodium sulfate therein.

A stirred tank of white liquor and either air or oxygen or a combination thereof and an external heat source is a common method of commercially producing white liquor as disclosed in U.S. Pat. Nos. 5,500,085 and 5,382,322.

The oxidation reaction of sodium sulfide is exothermic and generates a significant amount of heat. A typical stirred tank process used to oxidize sodium sulfide requires additional heat input from an external source and a long residence time in the tank for the oxidation reaction to progress to a beneficial extent. Large equipment is required to hold volumes of white liquor being oxidized. In particular two stirred tanks 10 feet in diameter and 26 feet high are used. Such large tanks require a long residence time, making them inefficient and costly.

SUMMARY OF THE INVENTION

The present invention is directed to a continuous dynamic reactor mixing assembly which disperses and dissolves a second fluid, e.g., gas, into a first fluid, e.g., liquid material. The reactor mixer of the invention employs first axially extending baffles and second circumferential baffles along with a unique agitator design to enable very efficient mixing of the first and second fluids. The invention is particularly well suited to conducting chemical reactions in the mixing assembly.

The mixing assembly of the present invention may be applied in mixing a wide variety of fluids and one, two, or three-phase mixtures. Some examples include the injection of a gas as a secondary fluid into the mixing chamber which already contains a liquid or liquid/solid material as a primary fluid or injecting a liquid as a secondary fluid into the mixing chamber for dissolution in and reaction with some primary fluid or slurried material within the mixing chamber. The secondary fluid may be introduced into the mixing chamber through insert assemblies which influence its flow rate. Virtually any combination of flowable materials may be introduced through both the insert assemblies and the mixing assembly as a whole.

The mixing assembly of the present invention is particularly well suited for conducting chemical reactions which involve the injection of a gas into a material for subsequent dilution and chemical reaction. Solutions which contain oxidizable compounds, such as paper pulp mill white liquor, black liquor, green liquor, and similar solutions are particularly suitable for oxidation reactions within the reactor mixer of the present invention. The patent application Ser. No. 08/893,601 entitled "Method of Oxidizing White and Black Liquor," filed Jul. 14, 1997, is incorporated herein by reference in its entirety, especially with regard to materials that may be oxidized in accordance with the present invention and an overall system for producing a solution of oxidized liquor in which the present reactor mixer may be used. When an oxidizing gas is admitted into the mixing chamber via the insert assemblies and an oxidizable liquor solution is flowing through the chamber, favorable oxidation reactions occur in relatively short time intervals, using relatively little energy. These and other advantages arise from the interplay of the baffling system and the unique agitator design causing a high degree of mixing.

In general, the present invention is directed to a dynamic mixing assembly comprising a preferably cylindrical mixing chamber having an inner wall which is generally symmetrical about a central (longitudinal) axis. At least one first fluid inlet introduces first fluid material into the mixing chamber. At least one second fluid inlet introduces second fluid material into the mixing chamber. At least one outlet enables fluid to leave the mixing chamber. First or axial baffles extend along the inner wall generally parallel to the axis for disrupting fluid flow generally circumferentially in the mixing chamber. Second or circumferential baffles extend generally transverse to the axis for disrupting fluid flow in a generally axial direction in the mixing chamber. The second baffles are constructed and arranged to segment the mixing chamber axially. A rotatable agitator comprises a cylindrical central portion extending in the mixing chamber along the axis and at least one blade having a twisted orientation on the central portion. The relative construction and arrangement among the first baffles, the second baffles and the agitator enable residence time of fluid in the reactor to be selectively adjusted.

In particular, the circumferential baffles partition the mixing chamber into at least two axial segments. The axial baffles in one of the segments are offset from the axial baffles in an adjacent one of the segments as viewed in a direction of the axis. A generally annular space is located radially between each blade and the axial baffles. A size of the space is selected to produce the particular residence time of liquid material in the mixing chamber. The space ranges from about 0.01 to about 0.1 times an inside diameter of the mixing chamber and, in particular, from about 0.03 to about 0.11 times an inside diameter of the mixing chamber. A ratio of a height of each of the axial baffles to an inside diameter of the mixing chamber ranges from about 0.001 to about 0.40 and, in particular, from about 0.01 to about 0.20. Each blade has a pitch such that there is a generally constant gap between an edge of the blade and edges of the axial baffles, along an entire length of the blade.

Also, insert assemblies may each be disposed at a location of a second fluid inlet adjacent the mixing chamber wall for admitting the second fluid into the reactor at a selected flow rate. A variable speed drive may be used that can rotate the agitator in both a clockwise and counterclockwise direction.

A preferred embodiment of the mixing assembly of the invention comprises the generally cylindrical mixing chamber having the inner wall which is generally symmetrical about the central axis, the first and second fluid inlets, and outlet. Also included are the axial and circumferential baffles. The circumferential baffles are constructed and arranged to segment the mixing chamber axially. The insert assemblies are each disposed at a location of a second fluid inlet adjacent the mixing chamber wall. The rotatable agitator comprises a central cylindrical hub portion extending in the mixing chamber along the axis and at least one blade having a twisted orientation on the hub portion. The relative construction and arrangement among the first baffles, the second baffles and the agitator enable residence time of fluid in the reactor to be selectively adjusted.

Another preferred embodiment of the mixing assembly of the present invention comprises the generally cylindrical mixing chamber having the inner wall which is generally symmetrical about the central axis, the first and second fluid inlets, and outlet. Also included are the axial and circumferential baffles. The circumferential baffles are constructed and arranged to segment the mixing chamber axially. The insert assemblies are each disposed at a location of a second fluid inlet adjacent the mixing chamber wall. The rotatable agitator comprises a central cylindrical hub portion extending in the mixing chamber along the axis and at least one blade having a twisted orientation on the hub portion. Each blade has a pitch such that a generally constant gap is maintained between an edge of the blade and edges of the axial baffles along an entire length of the blade. The generally annular space is located radially between each blade and the axial baffles. A size of the space is selected to produce a particular residence time of liquid material in the mixing chamber. Also included is the variable speed drive mechanism capable of both clockwise and counterclockwise rotation of the agitator. In particular, the assembly may include a device for pressurizing the liquid. The agitator can produce substantially superatmospheric pressure in the mixing chamber.

The reactor mixer of the present invention enables the efficient dispersion and dissolution of different materials into one another. In particular, the reactor mixer enables secondary gas to be inlet into the insert assemblies for oxidizing primary liquid material. The present invention enables the oxidation of white liquor solution to occur at least about 16 times faster than in the tank reactor system. These advantages are obtained by the design of the axial and circumferential baffles, insert assemblies and agitator.

The design of the agitator blades and axial and circumferential baffles offer numerous advantages and serve a plurality of purposes. The baffle systems disrupt axial and circumferential fluid flow and enable efficient mixing. A constant gap between the blades and the baffles is maintained upon passing of the blades. Only a small section of any blade is opposite any axial baffle at any one time, which lessens mixing power consumption. The twisted blade design on the central cylindrical portion of the agitator enables the blades to utilize a sweeping action past the inward edges of the axial baffles. Since the blades are twisted, only a small portion of a blade is advantageously opposite an axial baffle at one time by the predetermined space. The sweeping of the blades past the baffles causes a unique mixing action and further lessens mixing power consumption. Generally at least one point on at least one blade edge is separated from at least one point on at least one axial baffle edge by the predetermined gap, which maximizes mixing efficiency. The flow in the mixing chamber can be increased or retarded based upon the speed and rotational direction of the agitator, in view of its unique twisted blade orientation.

Further advantages are that the circumferential baffles advantageously partition the mixing chamber into one or more axial segments. When liquid contacts the circumferential baffles it is directed inwardly toward the agitator, forming a liquid seal in each of the axial segments. The liquid seal prevents gas from traveling unobstructed along the shaft of the mixing device. The present mixer is well suited for conducting chemical reactions, such as oxidation of liquids, in view of its thorough liquid/gas mixing. The reactor is believed to enable the formation of three discrete fluid zones, an inner primarily gas zone around the agitator, a primarily liquid zone radially outward from the gas zone, and a reaction zone between the liquid and gas zone having a combination of liquid and gas. An interaction among the axial baffles, circumferential baffles and agitator enable residence time of fluid (e.g., liquid) in the mixing chamber to be selectively adjusted. In particular, a generally radial spacing between the agitator and axial baffles enables the reaction zone size, and thus the residence time of the liquid, to be selectively adjusted.

A method of mixing first and second fluid materials according to the invention comprises directing the first and second fluid materials into the mixing chamber. The agitator having at least one blade with the twisted orientation on the cylindrical central portion is rotated. Fluid flow is disrupted generally circumferentially in the mixing chamber with the axial baffles. Fluid flow is disrupted in a general direction of the axis with the circumferential baffles. The residence time of liquid material in the mixing chamber may be selectively adjusted based upon the relative construction and arrangement among the agitator, the axial baffles and the circumferential baffles. This may be accomplished by selecting a size of the annular space located radially between the blades and the axial baffles. Alternatively, the residence time of liquid material in the chamber may be increased or decreased as desired by rotating the agitator in a particular direction and at a particular speed.

Many additional features, advantages and a fuller understanding of the invention will be had from the accompanying drawings and the detailed description that follows.

The drawings included as a part of this specification are intended to be illustrative of preferred embodiments of the invention and should in no way be considered a limitation on the scope of the invention.

Figure 1:
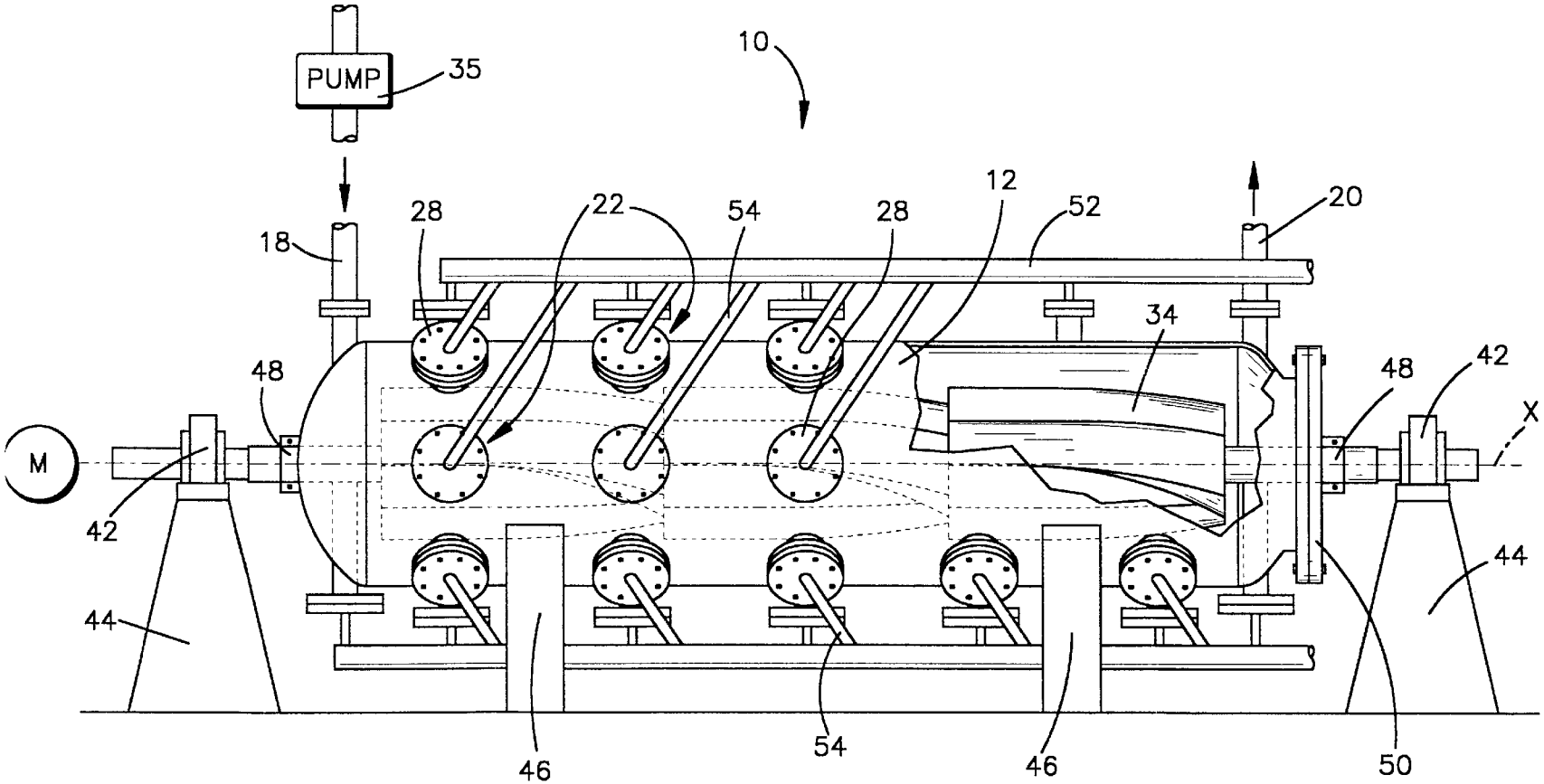
FIG. 1 is a side elevational view of a continuous dynamic mixing assembly constructed in accordance with the present invention.

DETAILED DESCRIPTION OF PREFERRED EMBODIMENTS:

Referring now to the drawings, a reactor mixer assembly of the present invention, which is for dispersion and dissolution of a secondary fluid material, preferably gas, into a primary fluid material, preferably liquid, is designated generally at 10. The mixing assembly comprises a generally cylindrical mixing vessel shell 12 having a wall 14 with an inner surface which forms a mixing chamber 16 that is generally symmetrical about a central axis X (FIG. 1). At least one first fluid inlet 18 is connected to the shell for introducing the first fluid material into the mixing chamber and at least one outlet 20 is connected to the shell for discharging mixed fluid from the mixing chamber. Second fluid inlets 22 are disposed at a plurality of locations around the mixing chamber for introducing the second fluid material into the first fluid material. First baffles 24 extend axially along the inner wall generally parallel to the axis X. Second circumferential baffles 26 extend generally transverse to the axis X and are constructed and arranged to partition the mixing chamber axially into at least two segments (e.g., $S_1$ and $S_2$). Insert assemblies 28 are disposed at each of the second fluid inlets 22 adjacent the mixing chamber wall. A rotatable agitator 30 comprises a cylindrical central portion 32 extending in the mixing chamber along the axis X and blades 34 that each have a twisted orientation on the central portion of the agitator.

The entry pipe 18 communicates with the mixing vessel shell in such a way that primary fluid from the entry pipe enters the mixing chamber 16. Entry pipe 18 is of sufficient size to admit the desired flow rate of primary fluid. The primary fluid may be pumped under pressure at a particular flow rate into the mixing chamber by a pump 35. After the mixing of the primary and secondary fluids, the mixed fluid leaves the mixing chamber via the exit pipe 20.

The agitator is driven by an external drive mechanism shown schematically at M and includes a shaft 36 that is coupled to a drive shaft 38 in a manner known to those skilled in the art. The agitator preferably includes a cylindrical hub portion 40 located concentrically around the shaft. The shaft 36 is supported by an appropriate bearing assembly 42 and pillow blocks 44. The mixing vessel shell is supported by suitable supports 46. The rotating shaft is sealed in the mixing vessel by suitable sealing devices 48. The sealing devices 48 are preferably dual-face rotating mechanical seals, although any suitable sealing mechanism may be used. Also, as shown in FIG. 1, included in the assembly is a removable cover 50, over a maintenance access hole, which is used for shaft removal and other tasks.

Secondary fluid enters secondary fluid entry headers 52, only one of which is shown in FIG. 1. From headers 52 the secondary fluid enters ports 54, which communicate with the insert assemblies 28. The headers 52 and the ports 54 may have other configurations. The secondary fluid flows into the mixing chamber through the insert assemblies 28. The insert assemblies 28 may be positioned at various locations around the mixing vessel shell 12.

Figure 2:
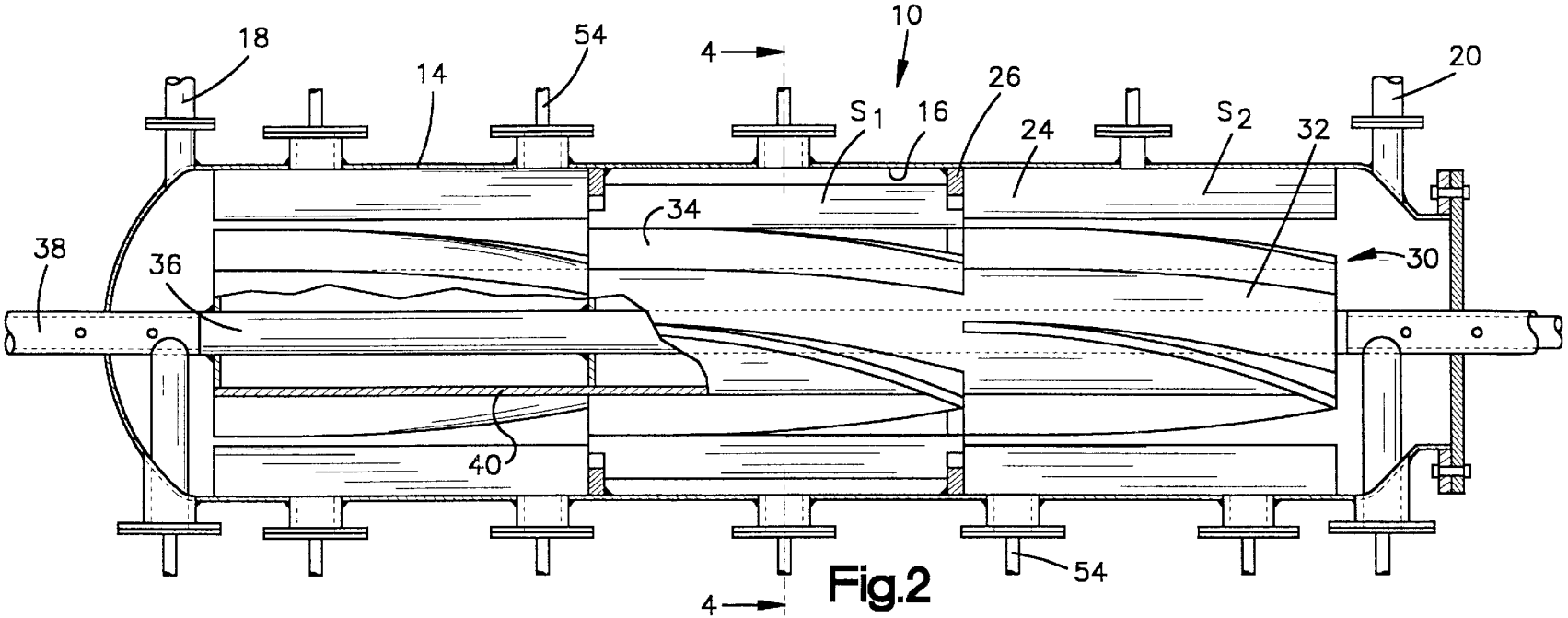
FIG. 2 is vertical cross-sectional side view of the mixing assembly.
Figure 4:
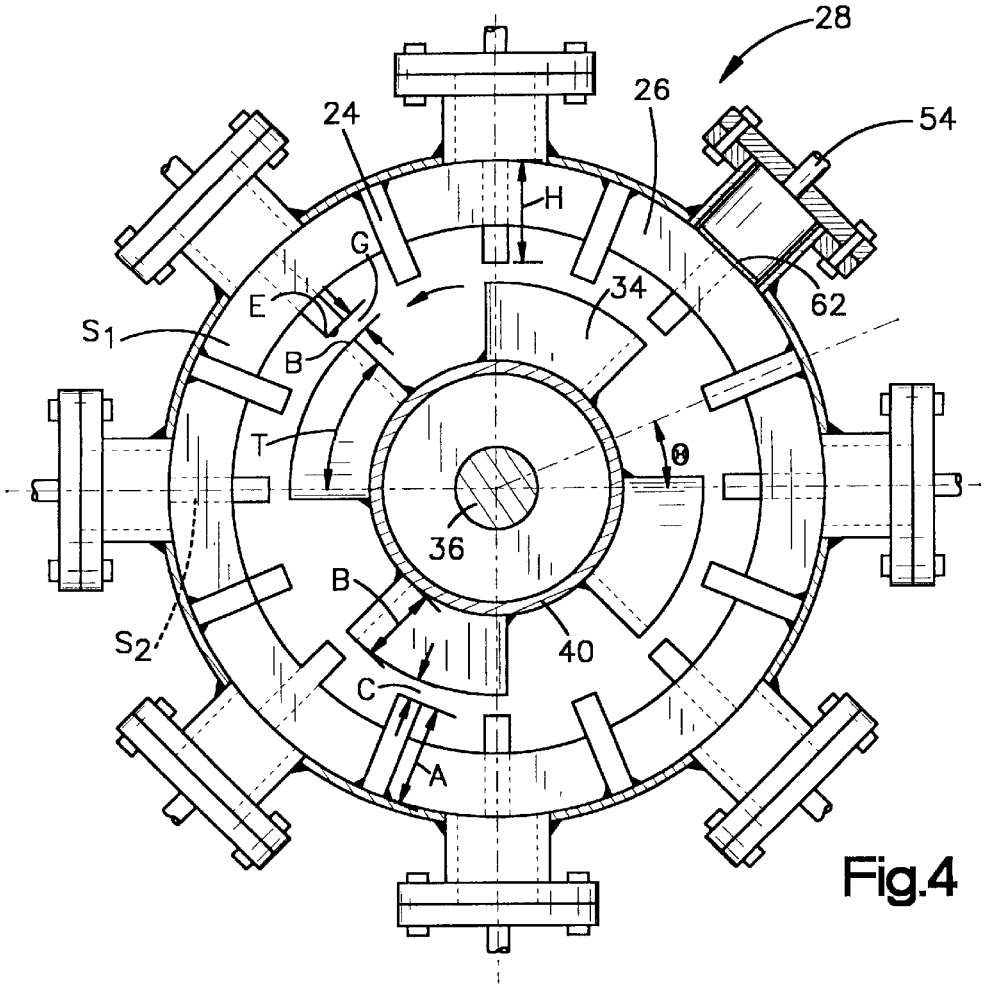
FIG. 4 is a cross-sectional view of the continuous dynamic mixing assembly of the present invention as approximately seen along the plane defined by lines 4-4 in FIG. 2.

Referring to FIGS. 2 and 4, the circumferential baffles 26 have an annular shape. The circumferential baffles 26 communicate with the inside wall of the mixing vessel shell 12 and partition the reactor into two or more axial segments. This disrupts the bulk flow of fluid material in the axial direction, causing definite axial segmentation in the mixing chamber and substantially lessening the possibility of fluid flowing axially through the chamber undermixed. The circumferential baffles 26 temporarily force the bulk flow of fluid generally radially into the agitator blades to ensure complete mixing, and to form a unique liquid barrier through which gases cannot pass unobstructed.

The axial baffles 24 extend generally radially inwardly from the inner wall of the mixing vessel shell and provide for circumferential mixing within an individual axial segment. As best shown in FIG. 4, the axial baffles in one of the segments $S_1$ are offset by an angle θ from the axial baffles in an adjacent one of the segments $S_2$ as viewed in a direction of the axis X. The angle θ ranges from about 0° to about 180° and, in particular, not greater than about 90°. The axial baffles 24 extend substantially the entire length of each axial segment and preferably have a length less than an axial segment. In a given axial segment the axial baffles may be circumferentially spaced apart from each other by a central angle ranging from about 0° to about 180°. A ratio of a height H of each of the axial baffles 24 to an inside diameter of the mixing chamber ranges from about 0.001 to about 0.40 and, in particular, from about 0.01 to about 0.20. The mixing chamber is about 20inches in diameter and about 6 feet long, for example.

Figure 3:
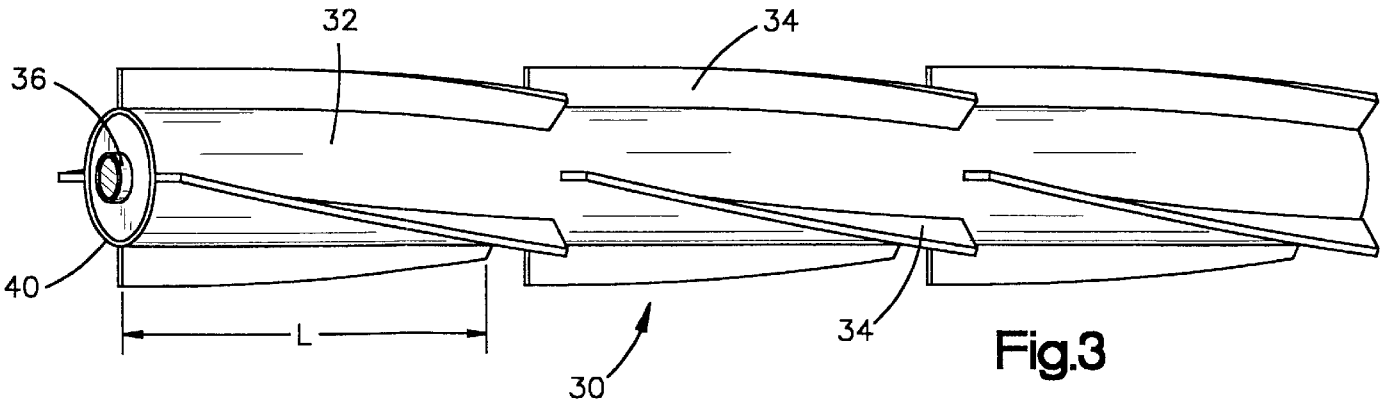
FIG. 3 is a perspective view of one embodiment of an agitator constructed in accordance with the present invention.

As shown in FIGS. 2 and 3, the hub portion of the multibladed agitator extends into the interior of the mixing chamber along the axis X. The shaft 36 extends through the vessel shell 12, the hub portion 40, the bearings 42 and the seals 48. Those skilled in the art will realize in view of this disclosure that the hub portion may be formed integrally with the shaft, formed separately from the shaft or otherwise omitted. For example, the blades may extend directly from a cylindrical shaft with no hub portion. The shaft 36 is preferably machined so that its outside diameter is less at the bearings 42 than along substantially the balance of the shaft.

Referring to FIG. 3, the blades 34 are advantageously twisted as shown, although other degrees of twist are within the scope of the current invention. It is preferred that the blades extend perpendicular to a tangent to the cylindrical portion as the blades twist, throughout the length of the blades. As shown in FIGS. 3 and 4, the blades have a pitch such that there is a generally constant gap G between each blade edge B and edges E of the axial baffles along the twist T for the entire length L of the blade. The blade twist T is important in that it lessens momentary power peaks that a blade parallel to the axis X would be prone to, and in that it creates a means to either propel the fluid from the mixing chamber or to retard the flow of fluid from the chamber. Thus, when the agitator is operated in accordance with the present invention, the twisted blades affect residence time of liquid material within the mixing chamber. The axial length L of each agitator blade (FIG. 3) is preferably approximately equal to that of each axial baffle.

Figure 5:
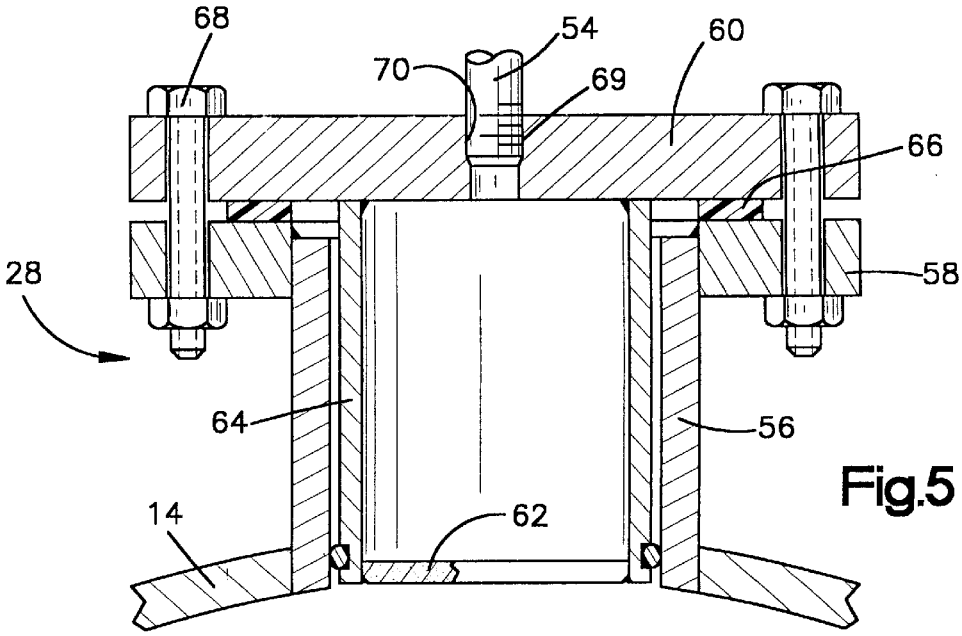
FIG. 5 is a detailed cross-sectional view of a preferred embodiment of an insert assembly constructed in accordance with the present invention.

Referring to FIG. 5, a preferred insert assembly 28 is shown, although other configurations may be used. U.S. Pat. No. 5,607,233 is incorporated herein by reference for specific features and effects of insert assemblies that may be suitable in the present invention. An insert sleeve 56 is connected to the vessel shell 12 such as by welding. A shoulder 58 extends from the insert sleeve 56 to allow an end cap 60 of the insert assembly 28 to engage the sleeve 56. An insert 62 communicates with an insert wall 64 which in turn communicates with the end cap 60. The inserts 62 are generally coplanar with the inner surface of the wall 14 but may extend further into the mixing chamber. The inserts 62 can admit different fluids and may be formed from materials so as to adjust their porosity as desired or to have drilled openings of a particular size and number, enabling a wide variety of flow rates of the secondary fluid into the mixing chamber. The inserts 62 are preferably removable. A gasket 66 may be used in conjunction with fasteners 68 to seal the end cap against the insert sleeve 56. Secondary fluid is injected into the insert via the feed pipe 54 which has exterior threads 69 for engaging an interiorly threaded opening 70 in the end cap.

Referring to FIG. 4, while not wanting to be bound by theory there are believed to be three fluid zones in the mixing chamber as viewed cross-sectionally in a direction of the axis X. The secondary fluid may be a gas, for example, an oxygen-containing gas. The primary fluid may be, for example, liquid material, for example, a liquor solution to be oxidized. Upon rotation of the agitator the centrifugal forces imparted by the blades on the fluid in the mixing chamber cause primarily liquid material to reside in an outer zone A located in an annulus radially between the inner surface of the wall 14 and the inner edges E of the axial baffles 24. Primarily gas is located in an innermost zone B located in an annulus that extends radially outwardly from the hub portion to the outer edges B of the blades. A discrete annular reaction zone C is located radially between the outer liquid material zone A and the inner gas zone B and contains a mixture of liquid and gas. The reaction zone C is located in the generally annular space G radially between the outermost edges of the blades and the edges of the axial baffles.

The size of the reaction zone C is selected to produce a particular residence time of liquid material in the mixing chamber. When the size of the reaction zone C is increased, the liquid material will have a longer residence time in the mixing chamber. When the size of the reaction zone C is decreased, the liquid material will have a shorter residence time in the mixing chamber.

The relative sizes of the zones A, B and C may be adjusted mechanically or operationally. The size of the space G may be determined when the reactor mixer is designed, by adjusting the size or height of the blades and the height of the axial baffles as well as the inside diameter of the mixing chamber. The space G preferably ranges from about 0.01 to about 0.1 times the inside diameter of the mixing chamber and, in particular, from about 0.03 to about 0.11 times the inside diameter of the mixing chamber.

The drive M is capable of variable speeds and can rotate the agitator clockwise or counterclockwise. While not wanting to be bound by theory, it is believed that the sizes of the zones are relatively constant or they may vary somewhat. Rotating the agitator assembly 40 clockwise, in view of the particular blade pitch and the view of FIGS. 3 and 4, propels the material out of the reactor, and is the most effective in reasonably gentle oxidation reactions. Clockwise rotation is also desirable when a rapid rate of mixing is required.

While not wanting to be bound by theory, the size of the reaction zone C may be affected by the directional rotation of the agitator. It is believed that clockwise rotation results in a relatively small reaction zone C. With clockwise rotation, the reaction zone C is believed to decrease in size radially outwardly, compared to counterclockwise rotation, that is, the size of the gas zone B increases. In a preferred embodiment, the agitator 40 is rotated counterclockwise, in view of the particular blade pitch and the view of FIGS. 3 and 4, in such a manner as to retard the bulk flow of liquid through the mixing chamber. It is believed that counterclockwise rotation results in a larger reaction zone C, which is very effective in harsh mixing or harsh oxidation reactions. With counterclockwise rotation, the reaction zone c is believed to increase radially inwardly, that is, the size of the gas zone B decreases.

The drive is preferably a variable speed drive that can be operated to rotate the agitator slowly or quickly. Slow rotation of the agitator is believed to increase the size of the reaction zone C and increases the residence time of the liquid material in the mixing chamber. Fast rotation of the agitator is believed to result in a smaller reaction zone C and decreases the residence time of the liquid material in the mixing chamber. Those skilled in the art will appreciate in view of this disclosure that the relative values of "fast" or "slow" rotational speed of the agitator and the effect these values and rotational direction have on liquid residence time in the reaction zone, can be empirically determined for each primary/secondary fluid system.

In operation, first fluid material, for example a white liquor solution to be oxidized, is directed through the inlet 18 at a certain flow rate into the mixing chamber 16. Second fluid material, for example, oxygen-containing gas, is directed along headers 52, through ports 54, and subsequently through the inserts 62 into the mixing chamber. The agitator 30 rotates at a particular speed and direction depending upon the desired residence time of fluid material in the reactor mixer. The residence time is also adjusted by selecting the size of the annular space G in view of the inside diameter of the mixing chamber and heights of each of the blades and axial baffles. Fluid flow is disrupted generally circumferentially in the mixing chamber by the axial baffles 24. Fluid flow is disrupted in a general direction of the axis by the circumferential baffles 26. The mixed fluid (e.g., oxidized white liquor) leaves the mixing chamber through the outlet 20.

The operating parameters of the system vary according to the dimensions and end use of the system, as well as many other factors. For purposes of illustration only, the mixing system can process from 0.1 to 500 gallons per minute of a pulp mill liquor converting the liquor to an oxidized liquor useful within pulp mill operations. The mixing chamber is capable of containing pressures up to 400 pounds per square inch gauge. The blade speed depends upon the geometry of the agitator and the degree of mixing required.

Figure 6:
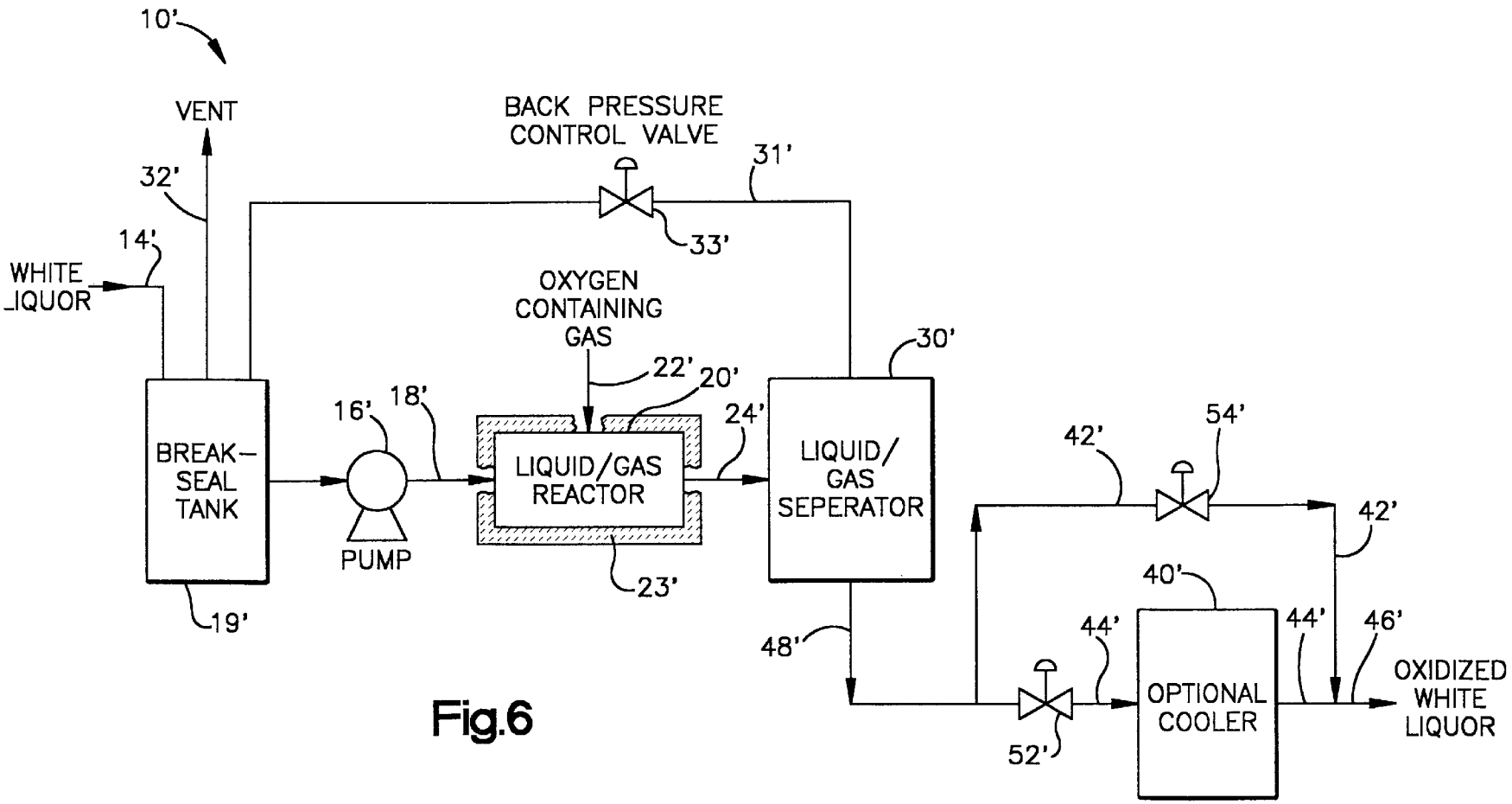
FIG. 6 is a schematic representation of a process for producing a solution of oxidized white liquor from a solution of white liquor according to the present invention.

Another preferred embodiment of the invention shown in FIG. 6 is a system 10' for producing a solution containing oxidized white liquor. System 10' includes an optional break-seal tank 19', high intensity liquid/gas reactor 20', liquid/gas separator or degasser 30' and an optional cooling device 40'. More specifically, high intensity liquid/gas reactor 20' receives white liquor through line 18' and in-line pump 16'. Line 18' is connect at one end to an inlet of high intensity liquid/gas Actor 20' and at the other end to an outlet of break seal tank 19', with pump 16' placed in line 18'. Break seal tank 19' receives white liquor directly from a mill (not shown) through line 14', As mentioned above, break-seal tank 19' is optional and is used primarily to provide a seal break in that it prevents oxygen from being pumped back into the mill (not shown). Pump 16' pumps a white liquor solution to be oxidized into high intensity liquid/gas reactor 20' through line 18'. After reacting with an oxygen containing gas, which gas is fed into high intensity liquid/gas reactor 20' through line 22', an oxidized white liquor solution is transferred through line 24' into liquid/gas separator tank 30'. Residual gas is removed from the oxidized white liquor solution through line 31' and is vented to break-seal tank 19' through line 31' and back-pressure control valve 33'. The residual gas is then vented to the atmosphere through line 32'. Back-pressure is maintained on the liquid/gas separator 30' and reactor 20' via back-pressure valve 33'. In the event that break-seal tank 19' is not used, a venting assembly consisting of a vent line and a back-pressure valve could be connected to liquid/gas separator 30'. The residual gas would then be vented directly to the atmosphere from liquid/gas separator 30'.

Optionally, before the oxidized white liquor solution is sent back to the paper mill process, it may be cooled by cooler 40', In this instance, valve 52' is opened and valve 54', which allows the oxidized white liquor to flow directly to the paper mill (not shown) through line 42', is closed. Oxidized white liquor solution is sent from liquid/as separator 30' through lines 48', 44' and valve 52' into cooler 40'. After cooling& the oxidized white liquor is sent to the paper mill (not shown) through lines 44', 46'. The oxidized white liquor solution may be sent directly to the paper mill by closing valve 52' and opening valve 54', The oxidized white liquor solution is sent through lines 48', 42', valve 54' and line 46' directly to the paper mill. In either case, i.e., use of the optional cooler or direct use of the hot oxidized white liquor as it exists the high intensity liquid/gas reactor, the exothennic heat of reaction may be captured for use in the pulp mill.

Refering now more specifically to the operation of system 10', a white liquor-containing solution is received from an existing pulp mill (not shown) into a break-seal tank 19'. From break-seal tank 19', the white liquor is pumped by pump 16', located in line 18', into high intensity liquid/gas reactor 20' through line 18'. Pressurized liquid/gas reactor 20' is provided to intensively mix fluid materials in liquid and gaseous form. The white liquor solution has, as its main constituents, reducing compounds that need to be oxidized before the solution may be used in a paper bleaching process. Reducing compounds common to the white liquor solution are sodium sulfide, sodium polysulfide and sodium thiosulfate. The oxidation of these compounds proceeds exothermically.

According to another aspect of the present invention, the white liquor solution and the oxygen containing gas are intensively mixed in the pressurized high intensity liquid/gas reactor, and the through put rates of the white liquor and the oxygen-containing gas are such that the exothermic heat of reaction is sufficient to autocatalyze the oxidation reaction. Once the autocatalytic stage has been reached, the reaction is almost incus and requires a very short residence time in the high intensity liquid/gas reactor.

in one respect, the efficiency of the present invention is combined by controlling the volume ratio of the through-put of liquid flow to the volume of the high intensity liquid/gas reactor. In the present invention, a volume ratio of through-put rate of liquid flow to the volume of the high intensity liquid/gas reactor ranges from about one gallon of through-put to about two gallons of reactor volume to about one gallon of through-put to about twenty gallons of reactor volume on a flow per mite basis, and preferably from about one gallon of through-put to about four gallons of reactor volume to about one gallon of through-put to about ten gallons of reactor volume on a flow per minute basis, and more preferably, from about one gallon of through-put to about five gallons of reactor volume to about one gallon of through-put to about seven gallons of reactor volume on a flow per minute basis.

The liquid/gas reactor must be capable of high intensity mixing of the oxygen-containing gas and the liquid such that it promotes a chemical reaction between sodium sulfide and oxygen. Accordingly, it will have a high through-put rate dictating a short residence time, a means for producing small oxygen gas bubbles and a means for intensively mixing the gas and liquid. The small volume/short residence time permits the exothermic reaction to proceed autocatalytically and is controlled by the feed rate of the gas and liquid streams and the mixing intensity of the liquid/gas reactor. A reactor suitable for this purpose is the reactor disclosed in U.S. Pat. No. 5,608,233, which is incorporated herein by reference. Another suitable reactor is the reactor mixing assembly 10 shown in FIGS. 1–5. It will be understood that throughout this description the reactor mixer 10 may be used instead of the reactor 20'.

In another embodiment of the present invention, the high intensity liquid/gas reactor may be thermally insulated with insulation 23' such that some of the heat from the exothermic reaction is maintained within the reactor.

Reactor 20' and reactor mixer 10 are adapted to mix components under pressure. More specifically, high intensity liquid/gas reactor 20' and reactor mixer 10 are provided for violently mixing a solution containing white liquor with an oxygen-containing gas under a pressure greater than atmospheric pressure, as will be described in greater detail below. As a result of the efficient mixing capability of the high intensity reactor, high intensity liquid/gas reactor 20' and reactor mixer 10 must be capable of maintaining a positive pressure of reactive gas therein.

When pumped into the reactor 20' or the reactor mixer 10, the white liquor solution is at its normal process temperature of about 60 degrees C. to about 100 degrees C., this temperature being the temperature of the white liquor as received from a paper pulping mill. A continuous stream of an oxygen-containing gas is furnished to reactor 20' or to the reactor mixer 10 through line 22', Oxygen flow rates may range from about 0.1 standard cubic feet per minute ("scfm") to about 10 scfm per gallon per minute ("gpm") of solution entering high intensity liquid/gas reactor 20' through line 18', preferably, oxygen flow rates may range from about 0.1 scfm to about 5scfm, and an oxygen flow rate of 3 scfm per gpm of solution is most preferred.

The pressure of the oxygen-containing gas may range from atmospheric pressure to about 350 pounds per square inch gauge ("psig"). Preferably, the pressure of the oxygen-containing gas may range from about 50 to about 350 psig, more preferably, from about 50 to about 200 psig, more preferably, from about 50 to about 150 psig and most preferably is about 140 psig. Oxygen, of the oxygen-containing gas, reacts with and oxidizes the reducing compounds of the white liquor. The oxidation reaction as described in the present invention is exothermic. As such, no external heat is supplied to reactor 20' or to the reactor mixer 10 as the oxidation reaction proceeds. As used herein, "external heat" refers to heat generated by a heat source external to reactor 20' and the reactor mixer 10. In this respect, no heat from an external heat source is added to the system to speed up the reaction. The heat that increases the reaction rate is produced chemically as a result of the exothermic oxidation reaction of the reducing compounds of the white liquor and the oxygen of the oxygen-containing gas, and to a lessor extent by friction developed by the operating components of the reactor and by the viscosity of the moving fluid contained threin. Exit temperatures of the oxidized white liquor range from about 100 degrees C. to about 200 degras C., preferably from about 110 degrees C. to about 160 degrees C. and more preferably, about 133 degrees C.

The aforementioned operating conditions result in reduced residence times of the white liquor solution in high intensity liquid/gas reactor 20' or in the reactor mixing assembly 10. In this respect, residence times ranging from about 10 seconds to about 10 minutes can be achieved. According to preferred operating conditions, residence times rig from about 10 seconds to about 2 minutes can be achieved. In a more preferable embodiment, the white liquor solution has a residence time of about 1.3 minutes in reactor 20'. It will be appreciated that the residence time of the white liquor solution may vary depending on the volume of the reactor and the inlet flow of white liquor solution into the reactor through the line 18'. It will be further appreciated that residence times may be less than those set forth hereinabove depending on the type of high intensity liquid/gas reactor employed and the method of mixing the white liquor solution and the oxygen-containing gas.

The method of the present invention as described hereinabove is to be contrasted to the methods presently known in that the volume ratio of the liquid flow rate in gallons per minute to the volume of the reactor in gallons is not only different than those presently known but are controlled in the following manner. In the present embodiment, a volume ratio of through-put rate of liquid flow to the volume of the high intensity liquid/gas reactor ranges from about one gallon of through-put to about two gallons of reactor volume to about one gallon of through-put to about twenty gallons of reactor volume on a flow per minute basis, and preferably from about one gallon of through-put to about four gallons of reactor volume to about one gallon of through-put to about ton gallons of reactor volume on a flow per minute basis, and more preferably, from about one gallon of throughput to about five gallons of reactor volume to about one gallon of through-put to about seven gallons of reactor volume on a flow per minute basis.

The present embodiment provides a method of oxidizing white liquor having reducing compounds, only traces of which are sodium sulfide, wherein about 50% to about 100%, preferably about 60% to 90% and more preferably about 70% to 85% by weight of the reducing compounds are oxidized to sodium sulfate.

The present embodiment thus provides a continuous flow-through process for the oxidation of white liquor to form an oxidized white liquor solution containing sodium sulfite as its primary constituent. The present embodiment may also be used to oxidize a "black liquor" solution. It is believed that the increased production rates of the present embodiment are realized by a faster, more efficient oxygen absorption into the liquid reaction mixture, be it white liquor, black liquor or other liquid reactants known in the art. This efficient increases the rate constant which allows the exothermic reaction to proceed autocatalytically without the addition of any external heat.

By illustration only and with no intent to be bound, one may best visualize the dynamics of this system of FIG. 6 by investigating the kinetic equations involved. It is believed that the rate determining equation of a given reaction mechanism is as follows:

$$r=k[A]^{\alpha}[B]^{\beta} \quad 1$$

where k is the standard rate constant, [A] and [B] represent the concentrations of reactants A and B respectively and $\alpha$ and $\beta$ are the exponential actors involved. Equation number 1 corresponds to the following chemical reaction;

$$aA+bB \rightarrow cC+dD+\ldots \quad 2$$

The rate constant k may be calculated by the following equation:

$$k=A^{*}\exp(-E_a/RT) \quad 3$$

where k is the standard rate constant, $A^{*}$ is the standard pre-exponential factor (Arrhunis A factor), $E_a$ is the activation energy of the reacton, R is the ideal gas constant and T is the absolute temperature of the reaction mixture.

In the ideal case, the reaction rate is a function of temperature only, given all other parameters such as concentrations, reaction mechanisms, diffisivities and gas absorption rates are constant. In reality, however, these parameters rarely remain constant For example, temperatures, diffisivities and gas absorption rates tend to vary.

The reaction rate of the present embodiment is about sixteen times faster than known heretofore. It is believed that changes as indicated in the following four parameters may result in an increased reaction rate: a lower $E_a$ value; a higher pre-exponential factor causing a higher rate constant; a higher reaction temperature; and, a faster, more efficient gas absorption into the reactive mixture, As previously mentioned, it is believed that the significant increase in the rate constant of the oxidation of white or back liquor as described herein is a result of a more efficient oxygen absorption into the liquid phase which contains chemical reactants. This enhanced absorption of oxygen into the liquid phase also allows the reaction to proceed autocatalytically without the addition of any external heat.

The following is an example, on a pilot plant scale, illustrating the production of an oxidized white liquor solution, having sodium sulfate as its primary constituent, from a white liquor solution, in accordance with the embodiment of FIG. 6.

EXAMPLE

In this example, an oxidized white liquor solution is produced such that about 84% by weight of its reducing compounds are oxidized to sodium sulfate with trace amounts of sodium sulfide remaining. A white liquor solution having 0.83 equivalents per liter of total reducing compounds is pumped from a source of white liquor into a high intensity liquid/gas reactor. The white liquor solution enters the reactor at about 73 degrees C. Oxygen gas is supplied to the reactor at a pressure of about 140 psig and at a rate of about 3 standard cubic feet per minute. The oxygen gas enters the reactor through porous metal plates and is mixed and entrained thoroughly within the white liquor solution resulting in the dissolution of some of the oxygen in the white liquor solution, In this example, the reactor contains a baffling arrangement to facilitate mixing. The entrained oxygen gas reacts with the reducing compounds of the white liquor in the reactor. This chemical reaction is exothermic. lmportantly, the exothermic heat produced by this chemical reaction is contained within the reactor and is used to catalyze the oxidation of the reducing compounds contained within the white liquor solution. No external heat, as defined herein, is furnished to the white liquor solution. The appropriate reaction temperature is maintained by the through-put rate of the white liquor and oxygen-containing gas and the intensity of mixing in the reactor.

As a result of the autocatalytic oxidation of the reducing compounds, the residence time of the white liquor in the reactor is about 1.3 minutes based on the total reactor volume and the feed flow rate of the white liquor solution into the reactor.

The oxidized white liquor solution and gas mixture exit the reactor at a temperature of about 133 degrees C. and are fed into a liquid/gas separator tank. Note that the rise in temperature, i.e., from about 73 degrees C. to about 133 degrees C., is, to a large degree, a result of the exothermic heat of reaction and the containment thereof in the reactor, and to a lesser degree, a result of internal fricton. In the liquid/gas separator tank, the residual oxygen gas is separated from the oxidized white liquor solution. Level control in the liquid/gas separator tank is achieved by controlling the rotation of the pump that pumps the white liquor solution into the reactor. The residual oxygen gas is vented to the atmosphere through a vent line connected to the liquid/gas separator tank and the oxidized white liquor solution is pumped from the bottom of the liquid/gas separator tank into a cooling tank for sampling.

In this example, a reactor pressure of about 140 psig is maintained by a back pressure control valve located in the vent line that extends from the liquid/gas separator tank to the atmosphere. After cooling, the oxidized white liquor solution is drawn from the cooling tank and tested. The oxidized white liquor solution is found to contain 0.130 equivalents per liter of total reducing compounds, reflecting about an 84% reduction by weight in reducing compounds, of which only trace amounts of sodium sulfide remain. This means that by weight about 84% of the original reducing compounds are converted to sodium sulfate.

As seen from this Example, the present embodiment provides a significantly reduced residence time, i e., 1.3 minutes as contrasted to those methods. presently known in the art. The present embodiment also does not require the addition of any external heat as is typically required by the methods presently known in the art.

Many modifications and variations of the invention will be apparent to those of ordinary skill in the art in light of the foregoing disclosure. Therefore, it is to be understood that, within the scope of the appended claims, the invention can be practiced otherwise than has been specifically shown and described.

What is claimed is:

1. A continuous dynamic mixing assembly, comprising:

a generally horizontally extending mixing chamber having an inner wall which is generally symmetrical about a central axis;

at least one first fluid inlet for introducing first fluid material into said mixing chamber;

at least one second fluid inlet constructed and arranged for introducing second, gaseous fluid material into said mixing chamber;

at least one outlet for discharging a mixture of said first fluid material and said second fluid material from the mixing chamber;

first baffles extending along the inner wall generally parallel to said axis for disrupting generally circumferential fluid flow in said mixing chamber;

second baffles extending from the inner wall generally transverse to said axis for disrupting generally axial fluid flow; and a rotatable agitator comprising a cylindrical central portion extending in said mixing chamber along said axis and at least one blade that extends from said central portion, the central portion being impervious to fluid flow;

wherein a relative construction and arrangement among said first baffles, said second baffles and said agitator enable residence time of fluid in said reactor to be selectively adjusted.

2. The mixing assembly according to claim 1 wherein said chamber is generally cylindrical.

3. The mixing assembly according to claim 1 wherein said at least one first fluid inlet is constructed and arranged to introduce liquid material into said mixing chamber.

4. The mixing assembly according to claim 1 comprising plate assemblies each disposed at a location of said at least one second fluid inlet adjacent the mixing chamber wall having one of a Particular porosity and sized openings effective to admit said second fluid material into said mixing chamber at a selected flow rate.

5. The mixing assembly according to claim 1 wherein said at least one blade has a pitch such that there is a generally constant gap between an edge of said at least one blade and edges of said first baffles along an entire length of said at least one blade.

6. The mixing assembly according to claim 1 wherein said second baffles partition said mixing chamber into at least two axial segments.

7. The mixing assembly according to claim 1 wherein a generally annular space is located radially between said at least one blade and said first baffles and said space has a size selected to produce a particular residence time of liquid material in said mixing chamber.

8. The mixing assembly according to claim 7 wherein said mixing chamber is generally cylindrical and said space ranges from about 0.01 to about 0.1 times an inside diameter of said mixing chamber.

9. The mixing assembly according to claim 7 wherein said mixing chamber is generally cylindrical and said space ranges from about 0.03 to about 0.11 times an inside diameter of said mixing chamber.

10. The mixing assembly according to claim 7 wherein said mixing chamber is generally cylindrical, said space being selected to range from about 0.01 to about 0.1times an inside diameter of said mixing chamber, and a ratio of a height of each of said first baffles to an inside diameter of said mixing chamber ranging from about 0.20 to about 0.40.

11. The mixing assembly according to claim 1 wherein a ratio of a height of each of said first baffles to an inside diameter of said mixing chamber ranges from about 0.001 to about 0.40.

12. The mixing assembly according to claim 1 wherein a ratio of a height of each of said first baffles to an inside diameter of said mixing chamber ranges from about 0.01 to about 0.20.

13. The mixing assembly according to claim 1 comprising a variable speed drive that is connected to said agitator and can rotate said agitator in clockwise and counterclockwise directions.

14. A continuous dynamic mixing assembly, comprising:

a mixing chamber having an inner wall which is generally symmetrical about a central axis;

at least one first fluid inlet for introducing first fluid material into said mixing chamber;

at least one second fluid inlet for introducing second fluid material into said mixing chamber;

at least one outlet for discharging a mixture of said first fluid material and said second fluid material from the mixing chamber;

first baffles extending along the inner wall generally parallel to said axis for disrupting generally circumferential fluid flow in said mixing chamber;

second baffles extending from the inner wall generally transverse to said axis for disrupting generally axial fluid flow in said mixing chamber; and a rotatable agitator comprising a cylindrical central portion extending in said mixing chamber along said axis and at least one blade that extends along an arc of said central portion;

wherein said second baffles partition said mixing chamber into at least two axial segments and the first baffles in one of said segments are circumferentially offset from the first baffles in an adjacent one of said segments as viewed in a direction of said axis, and wherein a relative construction and arrangement among said first baffles, said second baffles and said agitator enable residence time of fluid in said reactor to be selectively adjusted.

15. A continuous dynamic mixing assembly, comprising:

a generally horizontally extending mixing chamber having an inner wall which is generally cylindrical and symmetrical about a central axis;

at least one first fluid inlet for introducing first fluid material into said mixing chamber;

second fluid inlets disposed at a plurality of locations around said mixing chamber for introducing second fluid material into said mixing chamber;

at least one outlet for discharging a mixture of said first fluid material and said second fluid material from the mixing chamber;

first baffles extending along the inner wall generally parallel to said axis for disrupting generally circumferential fluid flow in said mixing chamber;

second baffles extending from the inner wall generally transverse to said axis for disrupting generally axial fluid flow in said mixing chamber, wherein said second baffles are constructed and arranged to segment the mixing chamber axially;

plate assemblies each disposed at a location of said second fluid inlet adjacent the mixing chamber wall having one of a particular porosity and sized openings effective to admit said second fluid material into said mixing chamber at a selected flow rate; and a rotatable agitator comprising a central cylindrical hub portion extending in said mixing chamber along said axis and at least one blade that extends along an arc of said hub portion;

wherein a relative construction and arrangement among said first baffles, said second baffles and said agitator enable residence time of fluid in said reactor to be selectively adjusted.

16. The mixing assembly according to claim 15 wherein a generally annular space is located radially between said at least one blade and said first baffles and said space is selected to produce a particular residence time of liquid material in said mixing chamber.

17. A continuous dynamic mixing assembly, comprising:

a generally horizontally extending mixing chamber having an inner wall which is generally cylindrical and symmetrical about a central axis, a liquid inlet for introducing liquid material into said mixing chamber, and an outlet for discharging mixed substances from said mixing chamber;

flow means disposed adjacent the mixing chamber wall for admitting a gaseous substance into said mixing chamber at a selected flow rate;

at least one gas port for introducing the gaseous substance into said mixing chamber through each of said flow means;

first baffles extending axially along the inner wall of said mixing chamber for disrupting generally circumferential fluid flow in said mixing chamber;

second baffles extending inwardly from said inner wall generally transverse to said axis for disrupting generally axial fluid flow in said mixing chamber, said second baffles partitioning said mixing chamber into at least two distinct axial segments;

a rotatable agitator comprising a cylindrical hub portion extending in said mixing chamber along said axis and blades that extend along arcs of said hub portion, each said blade having a pitch such that a generally constant gap is maintained between an edge of each said blade and edges of said first baffles along an entire length of said blade, wherein a generally annular space is located radially between said blades and said first baffles and a size of said space is selected to produce a particular residence time of liquid material in said mixing chamber; and a variable speed drive mechanism that is connected to said agitator and can rotate said agitator in clockwise and counterclockwise directions;

wherein a relative construction and arrangement among said first baffles, said second baffles and said agitator enable residence time of fluid in said reactor to be selectively adjusted.

18. The mixing apparatus according to claim 17 comprising means for pressurizing the liquid material.

19. The mixing apparatus according to claim 17 wherein said agitator can produce substantially superatmospheric pressure in said mixing chamber.

20. A method of mixing a first fluid material and a second fluid material, comprising:

directing the first fluid material into a generally horizontally extending mixing chamber having an inner wall which is generally symmetrical about a central axis;

directing the second fluid material into said mixing chamber;

rotating an agitator that comprises a cylindrical central portion extending in said mixing chamber along said axis and at least one blade extending from said central portion, the central portion being impervious to fluid flow;

disrupting generally circumferential fluid flow in said mixing chamber with first baffles that extend from the inner wall generally along said axis;

disrupting generally axial fluid flow with second baffles that extend from the inner wall generally transverse to said axis; and selectively adjusting residence time of fluid in said reactor based upon a relative construction and arrangement among said first baffles, said second baffles and said agitator.

21. The method according to claim 20 comprising adjusting a residence time of liquid material in said mixing chamber by selecting a size of an annular space located radially between said at least one blade and said first baffles.

22. The method according to claim 20 wherein said mixing chamber includes liquid material from at least one of said first fluid material and said second fluid material, comprising increasing a residence time of said liquid material in said mixing chamber by rotating said agitator in a direction to retard flow of said liquid material.

23. The method according to claim 20 wherein said first fluid material comprises a liquor used in the pulping of wood to make paper.

24. The method according to claim 23 wherein said first fluid material is white liquor.

25. The method according to claim 20 wherein said second fluid material comprises an oxygen-containing gas.

26. The method according to claim 20 comprising decreasing mixing power consumption based upon a relative construction and arrangement among said first baffles, said second baffles and said agitator.

27. The method according to claim 20 wherein said first fluid material is black liquor.

28. The method according to claim 20 wherein said first fluid material is green liquor.

29. The method according to claim 20 wherein said first fluid material comprises oxidizable compounds.

30. The method according to claim 20 comprising continuously conveying said first fluid material into said mixing chamber.

31. The method according to claim 20 comprising passing a mixture of said first fluid material and said second fluid material from said mixing chamber to a separator tank and pressurizing said mixing chamber using a pressure control valve in communication with said separator tank.

32. A continuous dynamic mixing assembly, comprising:

a generally horizontally extending mixing chamber having an inner wall which is generally symmetrical about a central axis;

at least one first fluid inlet for introducing first fluid material into said mixing chamber;

at least one second fluid inlet for introducing second fluid material into said mixing chamber;

at least one outlet for discharging a mixture of said first fluid material and said second fluid material from the mixing chamber;

first baffles extending along the inner wall generally along said axis for disrupting generally circumferential fluid flow in the mixing chamber;

second baffles extending from the inner wall generally transverse to said axis for disrupting generally axial fluid flow in the mixing chamber, said second baffles extending between said first baffles; and a rotatable agitator comprising a central portion extending in said mixing chamber along said axis and multiple blades extending outwardly from said central portion, wherein each of said blades extends along a different axial portion of said central portion than an adjacent one of said blades;

wherein said second baffles are disposed so that a portion of at least one of said second baffles is aligned transverse to said axis with a region that extends along said axis containing an axially terminal end of a first of said blades, and said second baffles partition said mixing chamber into at least two axial segments, wherein said first blade extends so as to be confined along said axis by said one second baffle in a first of said segments and a second of said blades that is adjacent said first blade extends so as to be axially confined by said one second baffle in a second of said segments that is adjacent said first segment.

33. The mixing assembly according to claim 32 wherein said central portion of said agitator is cylindrical and said blades extend along arcs of said central portion.

34. The mixing assembly according to claim 32 wherein said mixing chamber is generally cylindrical and a generally annular space is located radially between said blades and said first baffles, said space being selected to range from about 0.01 to about 0.1 times an inside diameter of said mixing chamber, and a ratio of a height of each of said first baffles to an inside diameter of said mixing chamber ranging from about 0.02 to about 0.40.

35. The mixing assembly according to claim 32 comprising a plurality of porous plate assemblies each disposed at a location of said at least one second fluid inlet adjacent the mixing chamber wall, said porous plate assemblies having one of a particular porosity and sized openings effective to admit said second fluid into said mixing chamber at a selected flow rate.

36. The mixing assembly according to claim 32 wherein the first baffles in one of said segments are circumferentially offset from the first baffles in an adjacent one of said segments as viewed in a direction of said axis.

37. The mixing assembly according to claim 32 wherein said first baffles and said second baffles extend inwardly from said inner wall of said mixing chamber transverse to said axis, said first baffles extending inwardly a greater distance than said second baffles.

38. The mixing assembly according to claim 37 wherein said second baffles have an annular shape and extend along said inner wall of said mixing chamber for the entire circumference of said mixing chamber.

39. The mixing assembly of claim 32 wherein said region is contiguous with an axially terminal end of said second blade.

40. A system for mixing fluid materials comprising:

(a) a continuous dynamic mining assembly comprising:

a generally horizontally extending mixing chamber having an inner wall which is generally symmetrical about a central axis;

at least one first fluid inlet for introducing first fluid material into said mixing chamber;

at least one second fluid inlet constructed and arranged for introducing second, gaseous fluid material into said mixing chamber;

at least one outlet for discharging mixture of said first fluid material and said second fluid material from said mixing chamber;

first baffles extending along the inner wall generally parallel to said axis for disrupting generally circumferential fluid flow in said mixing chamber;

second baffles extending from the inner wall generally transverse to said axis for disrupting generally axial fluid flow; and a rotatable agitator comprising a central portion extending in said mixing chamber along said axis and at least one blade that extends from said central portion, the central portion being impervious to fluid flow;

wherein a relative construction and arrangement among said first baffles, said second baffles and said agitator enable residence time of fluid in said reactor to be selectively adjusted;

(b) a separator tank for receiving said mixture that is discharged from said mixing chamber; and (c) a pressure control valve in communication with gas from said separator tank for pressurizing said mixing chamber.

41. A continuous dynamic mixing assembly comprising:

a generally horizontally extending mixing chamber having an inner wall which is generally symmetrical about a central axis;

at least one first fluid inlet for introducing first fluid material into said mixing chamber;

at least one second fluid inlet constructed and arranged for introducing second, gaseous fluid material into said mixing chamber;

at least one outlet for discharging a mixture of said first fluid material and said second fluid material from said mixing chamber;

first baffles extending along the inner wall generally parallel to said axis for disrupting generally circumferential fluid flow in said mixing chamber second baffles extending from the inner wall generally transverse to said axis for disrupting generally axial fluid flow; and a rotatable agitator comprising a central portion extending in said mixing chamber along said axis and at least one blade that extends from said central portion, the central portion being imperious to fluid flow;

wherein a relative construction and arrangement among said first baffles, said second baffles and said agitator enable residence time of fluid in said reactor to be selectively adjusted.

42. A system for mixing fluid materials comprising:

(a) a continuous dynamic mixing assembly comprising:

a generally horizontally extending mixing chamber having an inner wall which is generally symmetrical about a central axis;

at least one first fluid inlet for introducing first fluid material into said mixing chamber;

at least one second fluid inlet constructed and arranged for introducing second, gaseous fluid material into said mixing chamber;

at least one outlet for discharging a mixture of said first fluid material and said second fluid material from said mixing chamber;

first baffles extending along the inner wall generally parallel to said axis for disrupting generally circumferential fluid flow in said mixing chamber;

second baffles extending from the inner wall generally transverse to said axis for disrupting generally axial fluid flow; and a rotatable agitator comprising a central portion extending in said mixing chamber along said axis and at least one blade that extends from said central portion, the central portion being impervious to fluid flow;

wherein a relative construction and arrangement among said first baffles, said second baffles and said agitator enable residence time of fluid in said reactor to be selectively adjusted; and (b) means for removing gas from said mixture.

* * * * *